US005845843A

United States Patent [19]

Kuller

[11] Patent Number: 5,845,843

[45] Date of Patent: Dec. 8, 1998

[54] DOOR MOUNTED MAIL BOX

[76] Inventor: Merrill Kuller, 2150 Edgcumbe Rd., St. Paul, Minn. 55116

[21] Appl. No.: 841,765

[22] Filed: May 5, 1997

[51] Int. Cl.[6] ..... B65D 91/00

[52] U.S. Cl. ..... 232/38; 232/19; 232/17; 292/251.5

[58] Field of Search ..... 232/38, 28, 19, 232/45, 17; 292/251.5

[56] References Cited

U.S. PATENT DOCUMENTS

| | | | |
|---|---|---|---|
| 471,918 | 3/1892 | Van Pelt | 232/28 |
| 953,435 | 3/1910 | Pfahler | 232/45 |
| 961,897 | 6/1910 | Rosenberg et al. | 232/28 |
| 1,001,080 | 8/1911 | Rosenberg et al. | 232/28 |
| 2,194,226 | 3/1940 | Holdren | 232/19 |
| 2,507,785 | 5/1950 | Hartman | 232/19 |
| 3,647,165 | 3/1972 | Whitla | 292/251.5 X |
| 4,756,472 | 7/1988 | Hammons | 232/35 |

FOREIGN PATENT DOCUMENTS 1258272 2/1960 France .

*Primary Examiner*—Brian K. Green
*Assistant Examiner*—William L. Miller
*Attorney, Agent, or Firm*—Jacobson and Johnson

[57] ABSTRACT

A tray-like member extends horizontally outward from a vertically oriented panel and is hingedly attached to the panel to be swung upward to a closed position to form a box-like enclosure having an opening at the top. A lid is also hingedly attached to the panel for closing the top opening. A latch is provided interior of the enclosure for holding the tray member in the closed position until manually swung open and a releasable mechanism is provided on the underside of the lid to prevent the enclosure from being pulled open while the lid is closed. Further, a key-operated plunger lock can be attached to releasably lock the tray member in the closed position while the lid is closed.

4 Claims, 4 Drawing Sheets

DOOR MOUNTED MAIL BOX

FIELD OF THE INVENTION

This invention is directed toward providing an exterior mailbox or receptacle preferably on an outside door. More specifically, it is directed toward a mail receptacle comprising a tray-like member which is hingedly attached so that it can be swung closed to form a receptacle for receiving mail and conveniently swung open for removing the mail.

DESCRIPTION OF THE PRIOR ART

An early U.S. Pat. No. 471,918 by VanPelt describes a mail receptacle which has a member which swings closed to receive and hold the mail and then can be swung open to remove the mail but it is constructed and operates functionally in a totally different fashion than the instant invention. Among other things it does not swing fully open, it does not describe in any detail any means for latching the member in the closed position nor does it provide additional means for releasably locking the mailbox in the closed position.

U.S. Pat. No. 2,507,785 to Hartman shows a hingedly supported mailbox with a hingedly attached lid but which is constructed and which functions in a dissimilar fashion and, among other things, makes no provisions for the latching of the box in the closed position nor for releasably locking it in the closed condition in a fashion as in the present invention.

SUMMARY OF THE INVENTION

A tray-like member enclosed by walls along three sides or edges is hingedly attached along the top of one side wall to a vertical support panel in a fashion such that the tray member can be swung upward to a closed position against the panel to form a box-like enclosure having an open top for receiving mail. Latch members are located in the interior of the tray-like member and on the support panel to hold the tray member in closed position yet allowing it to be manually opened. A lid is hingedly attached to close the opening and has an arm or hub extending from the underside of the lid to engage the latching member in the tray-like member to prevent the tray-like member from being pulled open when the lid is closed A key-operated plunger-type lock mounted on a side wall of the tray-like member engages an opening in the hub on the closed lid so that the lid can be releasably locked closed to prevent unauthorized removal of the mail.

DESCRIPTION OF THE PREFERRED EMBODIMENTS

Figure 2:
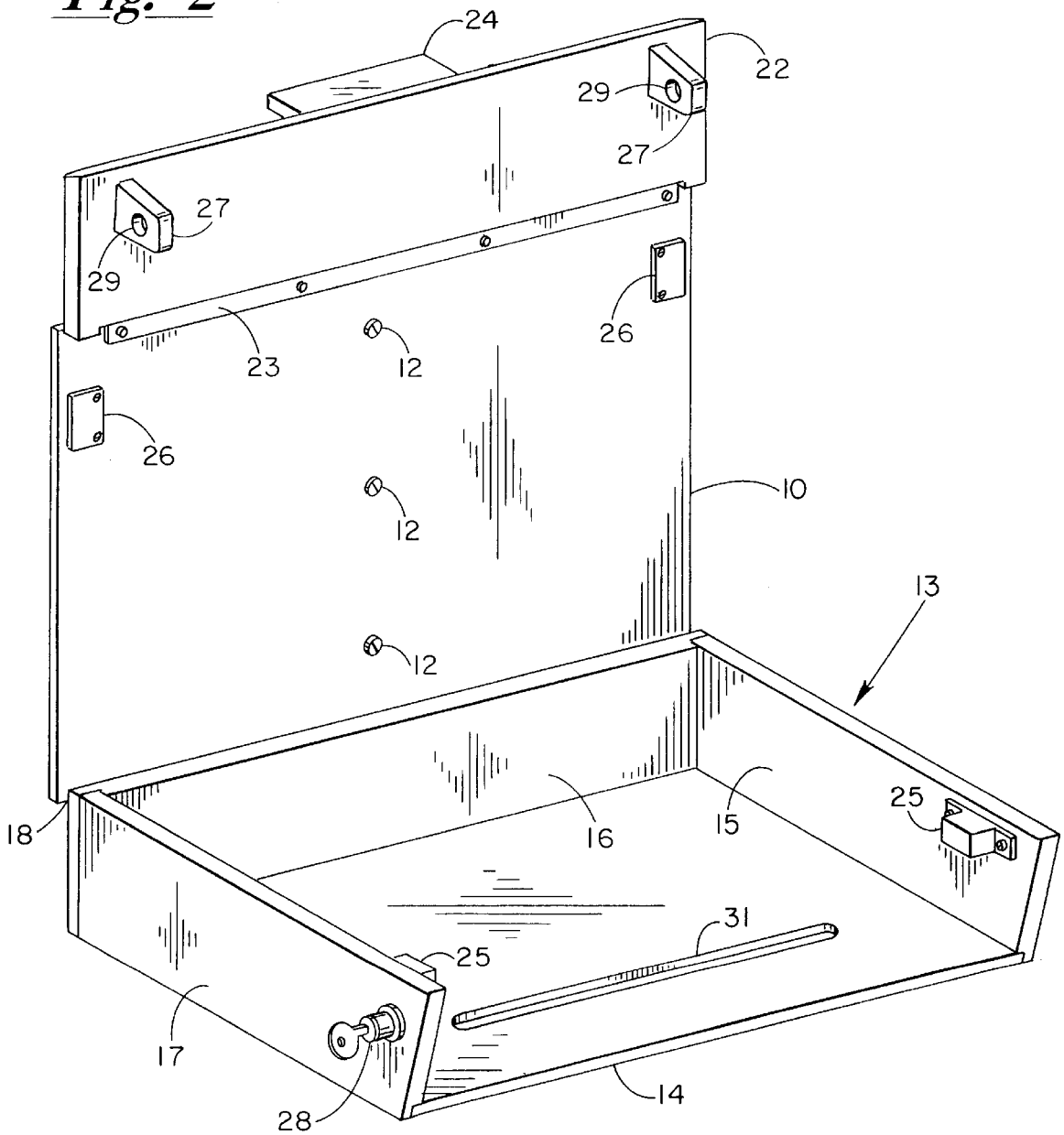
FIG. 2 is a perspective view of a preferred form of the invention in the open condition.
Figure 3:
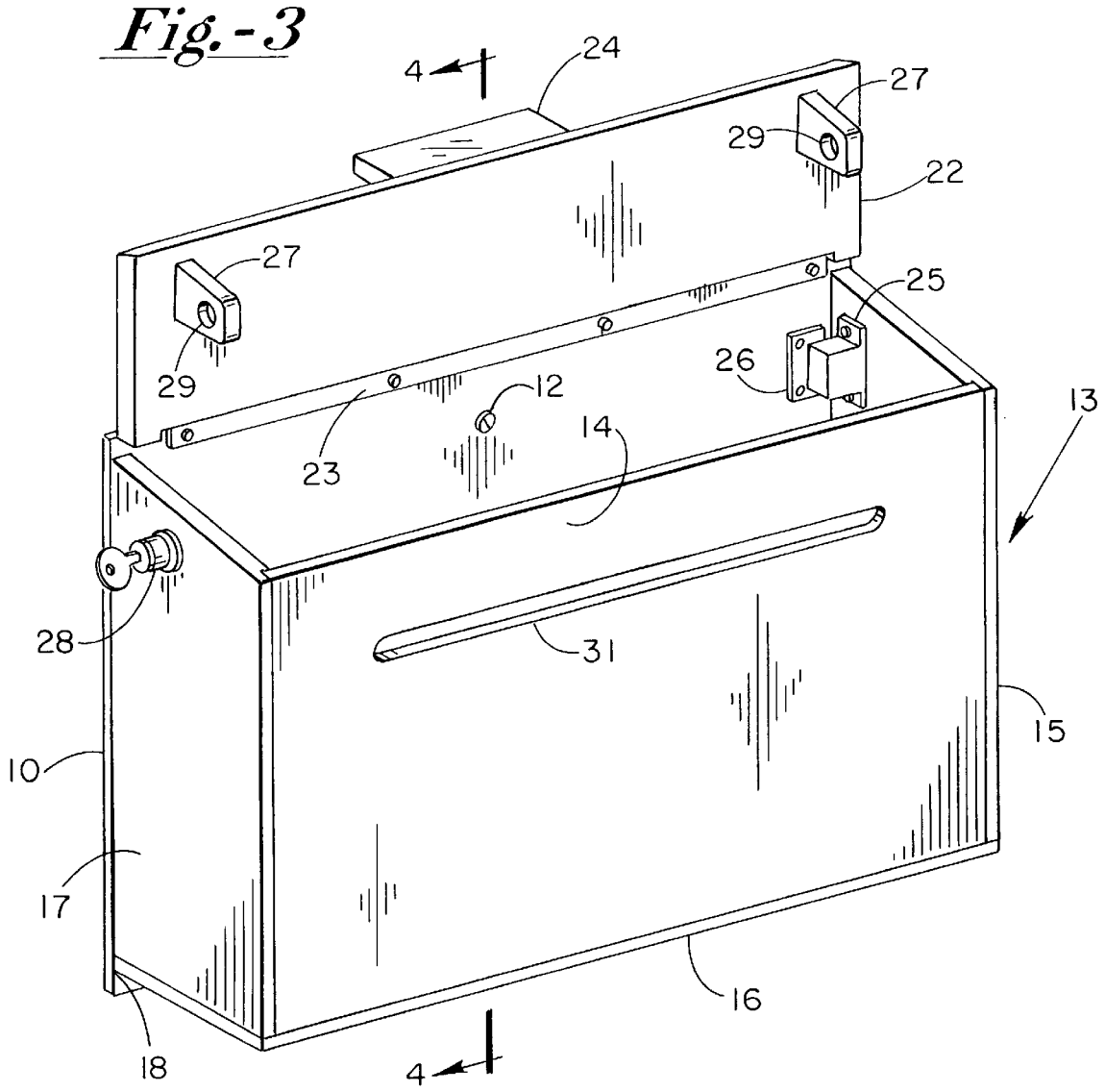
FIG. 3 is a perspective view in the closed condition but with the lid open.
Figure 4:
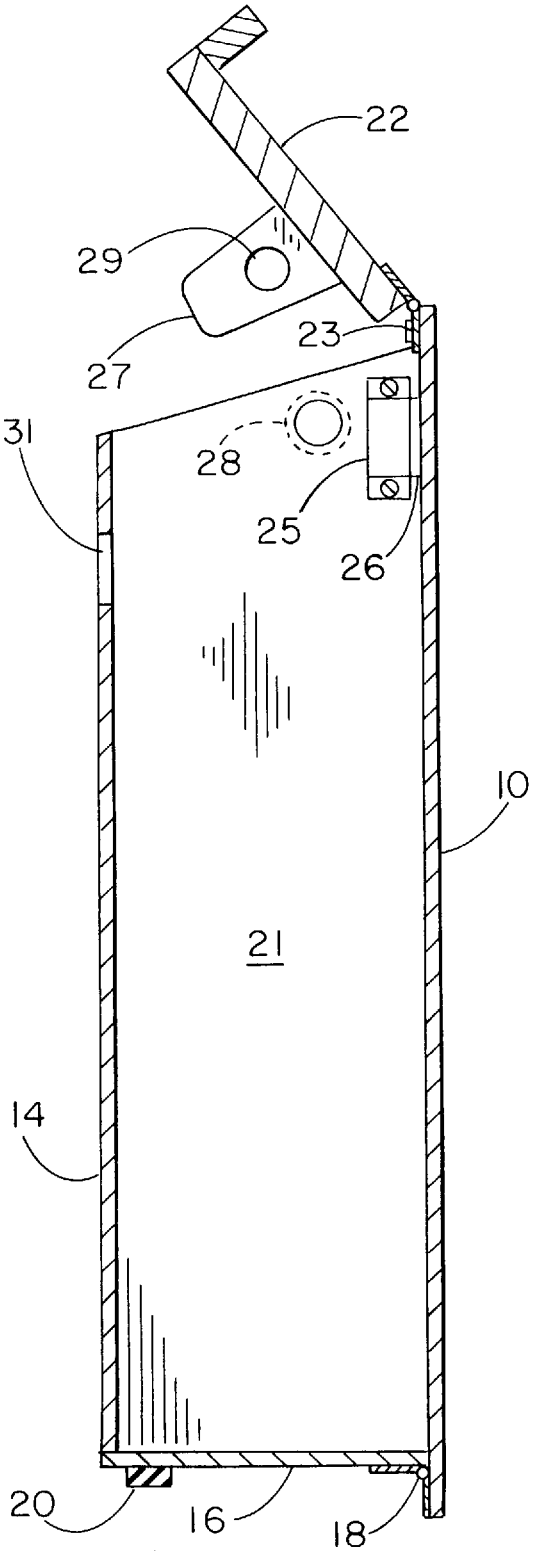
FIG. 4 is a vertical side sectioned view of the interior with the lid open.

A flat panel 10 is attached in any conventional fashion by nails or screws 12 to the outside of a conventional door 11. As will be apparent during the course of this description, alternatively the door itself could constitute panel 10. A tray-like member 13 having a rectangular flat plate member 14 which is enclosed along three sides by walls 15, 16 and 17 leaving the tray open along one side or edge opposite wall 16. Along its top edge wall 16 is attached to panel 10 by a hinge 18 such as a conventional piano hinge or similar. A rubber bumper or pad 20 is attached to the outside of wall 16 to act as a spacer and to prevent it from marring the door when tray member 13 is in the open position such as illustrated in FIG. 2. Tray member 13 is swung upward with respect to hinge 18 to form a box-like enclosure for receiving mail through an opening 21 which is the open end or edge of tray member 13. A lid or cover 22 is attached to panel 10 by a hinge 23 which can be similar to hinge 18 or something similar. Cover 22 is manually swung open or closed by using handle 24.

Mounted on the inside of wall 15 near its top edge and spaced somewhat inward from the open edge or side of tray member 13 is a magnetic holding bracket 25 and attached to panel 10 near the outer edge corresponding to side member 15 is a magnetic strike plate 26 which is located somewhat lower than the top edge of panel 10 so that it will mate with magnetic holding bracket 25. Members 25 and 26 together constitute a conventional magnetic latch so that when the tray member 13 is in the up or closed position members 25 and 26 magnetically latch together to hold the tray member closed Alternatively, other types of conventional commercially available mechanical latches can be used. To ensure a secure latch it is preferable that a second set of latching members be mounted on the panel support 10 and the inside of wall 17 in the same relationship corresponding to that of members 26 and 25.

Extending outward from the underside of lid 22 is a hub 27 which is located such that when cover or lid 22 is swung to close opening 21, hub 27 rests behind magnetic holding bracket 25 so that the tray member 13 cannot be pulled open. Preferably a similar hub is located opposite hub 27 on the underside of lid 22 near the opposite edge to similarly engage another magnetic holding bracket 25 on the inside of wall 17. This arrangement secures against the possibility of tray member 13 swinging open accidentally while lid 22 is closed. Mounted on wall 17 and extending through it into the interior of tray member 13 is a key-operated plunger lock 28 which is located to engage hole 29 in hub 27. This provides security for the mailbox by tray member 13 being locked in the closed position with the lid down and will remain so until released by a suitable key.

Normally tray member 13 and lid 22 are in the closed or enclosure-forming position and held in place by latch members 26 and 25 along with hub 27. Delivery of mail is made merely by lifting lid or cover 22 and depositing the mail into the interior of the box and then closing cover 22. The mail deliverer then operates plunger lock 28 to lock the box closed. Alternatively the plunger lock may be initially activated by the user and a slot 31 provided in plate member 14 through which the mail is inserted. To retrieve the mail the user unlocks plunger lock 28 with a suitable key, lifts lid 22 and then pulls tray member 13 away from panel 10 so that it swings open. A handle, not shown, may be provided on the outside of member 14 for convenience. The tray 13 now resting in the generally horizontal position as illustrated in FIG. 2 makes it convenient for the user to look at the mail at his or her leisure or just gather it up without bending over very far.

Figure 1:
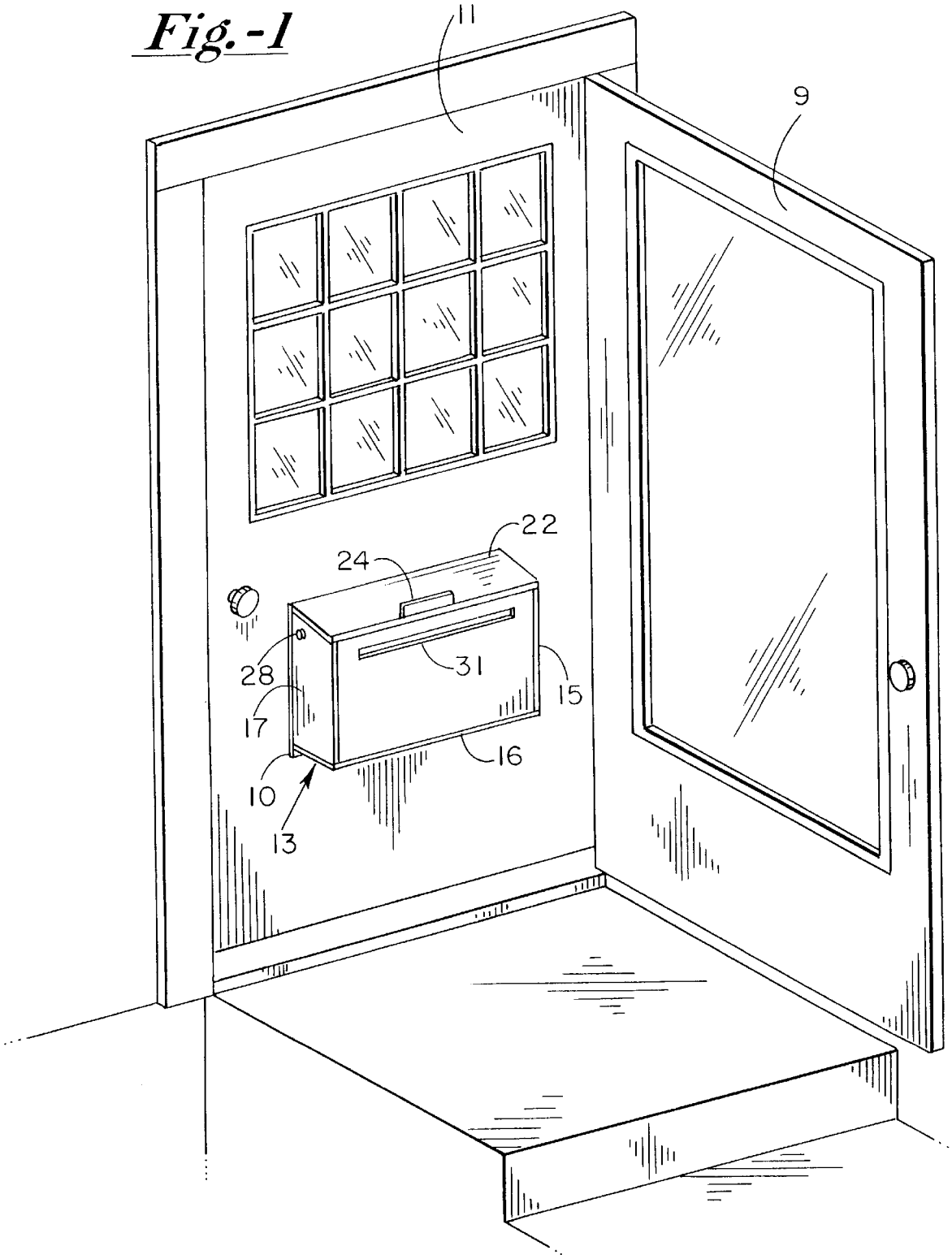
FIG. 1 is a view of the invention for use mounted on the outside of a door.

Conventionally the enclosure should be slanted or tapered at the open edge at about a fifteen to thirty degree angle so that snow or rain or any other foreign materials will slide off the closed lid. Instead of a slotted front plate a mail-inserting slot can be provided in or through side member 15 or 17.

Where the building has an outer screen or storm door 9 (FIG. 1), the depth of the mail receptacle should be such as to conveniently rest between the two doors when they are closed. The mail deliverer has to open the outer door 9 to deliver the mail but the recipient has the convenience of merely opening door 11 to remove the mail.

I claim:

1. A mailbox, comprising:

a) a generally vertical support panel;

b) a tray-like member comprising a generally rectangular flat plate member including three side walls and an unclosed side;

c) said tray-like member hingedly attached to said support panel at a top of one of said side walls which is opposite said unclosed side such that said tray-like member can be swung closed to form a box-like enclosure with said support panel, said enclosure having an open top and said tray-like member can be swung open to provide a horizontal tray;

d) a lid hingedly attached to said support panel for manually closing and opening the open top;

e) a first latch member attached to said support panel and a second latch member for releasably engaging said first latch member attached to an interior of at least one of said side walls of said tray-like member;

f) said engaged latch members holding said tray-like member in the closed position until said tray-like member is manually swung open; and g) a hub on the underside of said lid, said hub engaging said second latch member to prevent said tray-like member from being manually swung open while said lid is closed.

2. The mailbox as described in claim 1 wherein one of the latch members is a magnetic strike plate and the other latch member is a mating magnetic member.

3. The mailbox as described in claim 1 wherein:

said hub has an opening; and further including a key operated plunger lock attached to one of said side walls of said tray-like member for engaging said hub opening for releasably locking said lid closed.

4. The mailbox as described in claim 1 wherein said flat plate member has a slot for receiving mail.

* * * * *